US010934505B2

(12) United States Patent
Fox et al.

(10) Patent No.: US 10,934,505 B2
(45) Date of Patent: Mar. 2, 2021

(54) PRINTING PRESS WASH

(71) Applicant: Sun Chemical Corporation, Parsippany, NJ (US)

(72) Inventors: Jerome A. Fox, Algonquin, IL (US); James Nowaczyk, Oak Forest, IL (US)

(73) Assignee: SUN CHEMICAL CORPORATION, Parsippany, NJ (US)

( * ) Notice: Subject to any disclaimer, the term of this patent is extended or adjusted under 35 U.S.C. 154(b) by 12 days.

(21) Appl. No.: 16/445,382

(22) Filed: Jun. 19, 2019

(65) Prior Publication Data

US 2020/0040286 A1 Feb. 6, 2020

Related U.S. Application Data

(60) Provisional application No. 62/712,463, filed on Jul. 31, 2018.

(51) Int. Cl.

| | |
|---|---|
| ***C11D 7/50*** | (2006.01) |
| ***C11D 7/30*** | (2006.01) |
| ***B41N 3/00*** | (2006.01) |
| ***C11D 1/04*** | (2006.01) |
| ***C11D 1/29*** | (2006.01) |

(52) U.S. Cl.

CPC ..... *C11D 7/30* (2013.01); *B41N 3/006* (2013.01); *C11D 1/04* (2013.01); *C11D 1/29* (2013.01); *C11D 7/5027* (2013.01)

(58) Field of Classification Search

CPC ..... C11D 3/43; C11D 3/18; C11D 7/5027; C11D 11/0041

USPC ..... 510/170

See application file for complete search history.

(56) References Cited

U.S. PATENT DOCUMENTS

| | | | | |
|---|---|---|---|---|
| 4,829,897 | A | 5/1989 | Wyman et al. | |
| 5,340,495 | A | 8/1994 | Mulcahy et al. | |
| 8,207,103 | B2 | 6/2012 | Dabela et al. | |
| 8,512,481 | B2 | 8/2013 | Rondon et al. | |
| 9,683,205 | B2 * | 6/2017 | Dabela | C11D 3/43 |
| 2008/0280802 | A1 | 11/2008 | Dabela et al. | |
| 2008/0287331 | A1 | 11/2008 | Lin et al. | |
| 2013/0017986 | A1 * | 1/2013 | Dabela | C11D 3/188 510/170 |
| 2014/0311384 | A1 * | 10/2014 | Ledford | C09D 5/00 106/311 |
| 2015/0299499 | A1 * | 10/2015 | Ledford | C09D 5/022 524/43 |
| 2020/0040286 | A1 * | 2/2020 | Fox | C11D 1/04 |

FOREIGN PATENT DOCUMENTS

| | | | |
|---|---|---|---|
| EP | 0 435 943 | B2 | 7/2000 |
| EP | 1 511 833 | | 3/2005 |
| EP | 2 041 229 | A1 | 4/2009 |
| WO | WO 03/104365 | A2 | 12/2003 |
| WO | WO 2008/003161 | A1 | 1/2008 |
| WO | WO 2008/141210 | A1 | 11/2008 |
| WO | WO 2011/089238 | A1 | 7/2011 |

* cited by examiner

*Primary Examiner* — Gregory E Webb

(74) *Attorney, Agent, or Firm* — Frost Brown Todd LLC

(57) ABSTRACT

The present invention is drawn to a wash that will effectively clean printing related equipment such as a printing press, including all of its components, of materials used in the printing process, including printing inks, paper, and fountain solutions.

7 Claims, No Drawings

PRINTING PRESS WASH

BACKGROUND

Relevant Documents

U.S. Pat. No. 9,683,205
US20120220511
US20080280802
U.S. Pat. No. 8,207,103
WO2008141210
US20080287331
U.S. Pat. No. 8,512,481
U.S. Pat. No. 5,340,495
EP2041229
EP1511833
U.S. Pat. No. 4,829,897
EP0435943
WO2011089238

The key advantage to the press washes of the present invention is improved cleaning power and efficiency over other low VOC (volatile organic compounds) South Coast Air Quality Management District (SCQAMD) compliant washes when cleaning printing ink and paper residue from rollers in the press ink train, the printing plate, and the printing blanket, without the negative effects that inhibit the printing process, such as slow evaporation and drying. The press washes of the present invention advantageously are formulated to inhibit corrosion of the metal parts of the printing press that the wash will come in repeated contact with. In a preferred embodiment, the press washes of the present invention would be used for cleaning offset printing presses.

Low VOC press washes generally refers to 100 grams/liter or less volatile organic compounds.

Typical low VOC press washes comprise up to 40% water, while the press washes of the present invention preferably comprise >45% water, more preferably >50% water and most preferably >55% water.

This technology will enable printers who are either required to comply or choose to comply with South Coast Air Quality Management District's (SCAQMD) 100 grams/liter VOC Regulation to remove materials used in the printing process, including printing ink wet or dried, paper dust and residue, and fountain solutions, as well as materials that are not necessarily part of the printing process but are present in the equipment, such as grease and oils, from surfaces on the printing press, including rubber and metal rollers, printing plates, printing blankets, ink fountains, and other parts and surfaces of the printing press with results similar to washes that do not comply with SCAQMD's Regulation. Corrosion inhibitor(s) are preferably added to reduce or prevent corrosion of the metal parts of the printing press. The advantage to materials that meet SCAQMD regulations is reduced environmental impact and improved workplace safety.

DETAILED DESCRIPTION OF THE INVENTION

The present invention is drawn to a wash that will effectively clean printing related equipment such as a printing press, including all of its components, of materials used in the printing process, including printing inks, paper, and fountain solutions.

Preferable materials and amounts for the inventive washes are as follows:

A wash comprising a mixture of 10-50% PCBTF [Parachlorobenzotrifluoride]; 0.1-10% of a 100% VOC solvent per EPA CFR Promulgated Test Method 24 with a flashpoint above 100° F., for example Aromatic 100, Mineral Spirits, Aliphatic 142 Solvent, Aromatic 150; 0.1-10% solvent with less than 100% VOC per Method 24, for example mineral oil or paraffin solvent; 0.10-5% surfactants, for example sodium monooleate and dioctyl sodium sulfosuccinate; 0.10-5% corrosion inhibitors such as Tinsco EWSci from Marott Graphics or NA SUL 729 from King Industries; and preferably ≥45% water, more preferably ≥50% water, most preferably ≥55% water.

Physical properties of the wash:

Volatile Organic Compound (VOC) level≤100 grams per liter, minus exempt solvents Flash point above 100° F.

Water content of the wash≥50% by weight

Dynamic Surface Tension (DST) preferable range is 20-40 Sensadyne Surface Tensiometer 6000, more preferable is 25-40 (note: prior art washes are typically lower, around 18-22).

Viscosity Brookfield—100 rpm, #3 spindle, 75-200 cps

The wash is prepared by mixing the ingredients, preferably for a minimum of one hour, more preferably up to four hours, at a minimum of 500 rpm but less than 1,500 rpm, with a mixing blade sufficient to generate low shear blending at ambient temperature.

The wash is applied, preferably undiluted, to the surface to be cleaned either directly or first poured onto an absorbent rag, towel, or wipe, with an open top or squeeze bottle at a quantity sufficient to clean the surface and wiped until clean. Subsequently drying with a clean dry rag can reduce the time for the surface to be dry. For a printing press roller train, the cleaner is preferably incorporated into the roller train with a squeeze bottle, allowed to break down the ink and residue, then the ink and residue are removed from the rollers with a rubber blade and collected in a pan.

EXAMPLES

The following examples illustrate specific aspects of the present invention and are not intended to limit the scope thereof in any respect and should not be so construed.

Example 1

Wash

| | |
|---|---|
| Aromatic 100 solvent | 9.50 |
| Parol 70 solvent | 5.00 |
| PCBTF [Parachlorobenzotrifluoride) | 20.00 |
| dioctyl sodium sulfosuccinate | 0.25 |
| sodium monooleate | 1.25 |
| corrosion inhibitor | 1.00 |
| water | 63.00 |
| Total | 100.00 |

Example 2

Wash

| | |
|---|---|
| Aromatic 100 solvent | 9.50 |
| PCBTF [Parachlorobenzotrifluoride) | 25.00 |
| dioctyl sodium sulfosuccinate | 0.25 |
| sodium monooleate | 1.25 |
| corrosion inhibitor | 1.00 |
| water | 63.00 |
| Total | 100.00 |

Example 3

Wash

| | |
|---|---|
| Aliphatic 142 solvent | 9.50 |
| Parol 70 solvent | 5.00 |
| PCBTF [Parachlorobenzotrifluoride) | 20.00 |
| dioctyl sodium sulfosuccinate | 0.25 |
| sodium monooleate | 1.25 |
| corrosion inhibitor | 1.00 |
| water | 63.00 |
| Total | 100.00 |

Example 4

Wash

| | |
|---|---|
| Aromatic 150 solvent | 9.50 |
| Parol 70 solvent | 5.00 |
| PCBTF [Parachlorobenzotrifluoride) | 20.00 |
| dioctyl sodium sulfosuccinate | 0.25 |
| sodium monooleate | 1.25 |
| corrosion inhibitor | 1.00 |
| water | 63.00 |
| Total | 100.00 |

Wash Evaporation—Inkometer Test for Heatset Ink

This test is performed using a GO Technologies, Model 101 Inkometer.

1. Using a standard heatset ink, for example FFWWH5182478 from Sun Chemical, apply a full pipette (about 1.4 grams) to the rollers, let it distribute for 15 seconds, and increase the speed to 1200 fpm while turning the timer on. Run the tack for one minute.
2. Apply ten drops (about 0.30 grams) of wash to the rollers and run the tack out for ten minutes.
3. The timer will record the tack each minute and observe the tack recovery each minute.
4. Compare the tack recovery of all tested samples against the established ink tack increase with no wash added.

Grading: The more similar the final (10 minute) tack is to the established ink tack increase with no wash added, the better the evaporation. Use the difference in tack for comparison of samples.

TABLE 1

Wash Evaporation Results for Heatset Ink
Inkometer Stability

| | 1 min. | 2 min. | 3 min. | 4 min. | 5 min. | 6 min. | 7 min. | 8 min. | 9 min. | 10 min. |
|---|---|---|---|---|---|---|---|---|---|---|
| FFWWH5182478 | 9.4 | 10.4 | 11.4 | 12.3 | 13.1 | 13.9 | 14.7 | 15.3 | 15.8 | 16.2 |
| Alpha 8* Wash | 9.4 | 8.9 | 9.9 | 10.9 | 11.7 | 12.5 | 13.3 | 14.1 | 14.9 | 15.3 |
| Example 1 Wash | 9.4 | 9.7 | 10.5 | 11.3 | 12.0 | 12.8 | 13.5 | 14.2 | 14.9 | 15.4 |

*Alpha 8 (Explorer Pressroom Solutions) is an industry standard low VOC press wash that was used throughout the testing for comparative purposes.

Table 1 shows that the Example 1 wash has good evaporation properties, nearly identical to the comparative Alpha 8 wash.

Wash Cleaning—Ink Removal Inkometer Test for Heatset Ink

This test is performed using a GO Technologies, Model 101 Inkometer.

1. Using a standard ink (FFWWH5182478), apply a full pipette (about 1.4 grams) to the rollers, let it distribute for 15 seconds, and increase the speed to 1200 fpm while turning the timer on.
2. Run the tack for one minute.
3. Turn the inkometer down to 400 rpm and disengage the oscillation roller.
4. Dispense 20 drops (about 0.60 grams) of each wash under test to either side of the rollers and let distribute for 15 seconds.

5. Using a squeegee as a doctor blade holding it against the bottom of the middle bronze roller, squeegee off as much wash and ink as possible.
6. Observe squeegee to see which removes more ink.

TABLE 2

Wash Cleaning Ink Removal Test for Heatset Ink

| Test Procedure | Wash Ratings | |
|---|---|---|
| | Alpha 8 | Example 1 |
| Wash Cleaning Ink Removal - Inkometer | 6 | 8 |

Grading for ink removal is a visual test with the following scale: 1 = no ink removal from the rollers; 10 = complete ink removal.

Table 2 shows that the inventive Example 1 wash has superior ink removal wash properties vs. the comparative Alpha 8 wash.

Wash Evaporation and Recovery—Little Joe Test

This test is performed on a Little Joe Proofing Press

1. Apply three clicks (about 0.75 grams) of offset sheetfed Diamond Cyan, for example DIA-25 from Sun Chemical, onto the brayer and distribute evenly over the metal plate.
2. Ink the transfer plate, transfer to the blanket, re-ink the transfer plate and transfer to the blanket a second time.
3. Apply about 10 grams of wash onto a Kimwipe®.
4. Prepare a second Kimwipe as in step 3 using a second wash.
5. Wipe each side of the inked blanket with the wash-soaked Kim wipes and set a timer for four minutes.
6. When four minutes has passed, engage the blanket and pull a print over any card stock.
7. Observe the print to see which side has more ink transfer to the card stock and less solvent present on the card stock. Better performance is exhibited by more ink transfer and less solvent.

TABLE 3

Wash Evaporation and Recovery for Sheetfed Ink

| Test Procedure | Wash Ratings | |
|---|---|---|
| | Alpha 8 | Example 1 |
| Wash Evaporation and Recovery - Little Joe | 6 | 8 |

Grading is a visual test with the following scale: Grading: 1 = little to no ink transfer and heavy solvent; 10 = heavy ink transfer and less solvent Table 3 shows that the inventive Example 1 wash has superior wash Evaporation and recovery properties vs. the comparative Alpha 8 wash.

Wash Cleaning, Single Wipe—Little Joe Test

This test is performed on a Little Joe Proofing Press

1. Apply three clicks (about 0.75 grams) of offset sheetfed Diamond Cyan, for example DIA-25 from Sun Chemical, onto the brayer and distribute evenly over the metal plate.
2. Apply about 10 grams of wash onto a Kimwipe.
3. Prepare a second Kimwipe as in step 3 using a second wash.
4. Wipe each side of the inked blanket with the wash-soaked wipes. Observe the print to see which side has less ink removed, and grade accordingly.

TABLE 4

Wash Cleaning, Single Wipe - Little Joe Test for Sheetfed Ink

| Test Procedure | Wash Ratings | |
|---|---|---|
| | Alpha 8 | Example 1 |
| Wash Cleaning, Single Wipe - Little Joe | 8 | 8 |

Grading for ink removal is a visual test with the following scale: 1 = no ink removal from the rollers; 10 = complete ink removal.

Table 4 shows that the Example 1 wash has equal cleaning to the Alpha 8 wash on the Little Joe Press for a sheetfed ink at a faster drying rate (as shown in Table 3).

Wash Cleaning, Complete—Little Joe Test for Sheetfed Ink

This test is performed on a Little Joe Proofing Press

1. Apply three clicks (about 0.75 grams) of offset sheetfed Diamond Cyan, for example DIA-25 from Sun Chemical, onto the brayer and distribute evenly over the metal plate.
2. Ink the transfer plate, transfer to the blanket, re-ink the transfer plate and transfer to the blanket a second time.
3. Apply about 10 grams of wash onto a Kimwipe.
4. Wipe the entire inked blanket with the wash-soaked wipe, turning and re-folding the wipe as necessary.
5. Record the amount of ink removed from the blanket once no more ink can be removed with the current wash-wetted wiper.
6. Repeat the entire test with the second wash included in the testing.

TABLE 5

Wash Cleaning, Complete - Little Joe Test for Sheetfed Ink

| Test Procedure | Wash Ratings | |
|---|---|---|
| | Alpha 8 | Example 1 |
| Wash Cleaning Complete - Little Joe | 8 | 8 |

Grading for ink removal is a visual test with the following scale: 1 = no ink removal from the rollers; 10 = complete ink removal.

Table 5 shows that the Example 1 wash has equal cleaning to the Alpha 8 wash on the Little Joe Press for a sheetfed ink at a faster drying rate (as shown in Table 3).

Mixing Wash into Ink for Sheetfed Ink

1. Weigh 100 grams of ink, such as DIA-25 Diamond Cyan
2. Using a high-speed mixer with a Cowles blade, mix the ink at 200 rpm
3. Add 20 ml of wash, 2 ml at a time every two minutes while observing and recording how the wash mixes into the ink.

This test is meant to observe how the wash will mix into the ink on a regular mixer, which mimics high speed emulsion testing on founts.

Results:

Alpha 8 wash had a difficult time mixing into the ink with a tendency to collect on the top of the ink and on the sides of the vessel. Extra mixing was required to get the wash to go into the ink.

Example 1 wash mixed in very easily and did not collect on the top of the ink or on the sides of the vessel.

This test indicates the stronger solvency and cleaning power of the Example 1 wash.

The present invention has been described in detail, including the preferred embodiments thereof. However, it will be appreciated that those skilled in the art, upon consideration of the present disclosure, may make modifications and/or improvements on this invention that fall within the scope and spirit of the invention.

The invention claimed is:

1. A low VOC press wash comprising 10-50% parachlorobenzotrifluoride; 40-70% water; 0.1-10% of a 100% VOC solvent with a flashpoint above 100° F.; 0.1-10% solvent with less than 100% VOC; 0.10-5% surfactants; and optionally a corrosion inhibitor, wherein the surfactant is selected from sodium monooleate and dioctyl sodium sulfosuccinate and blends thereof.

2. The press wash of claim 1, wherein the water content is 50-70%.

3. The press wash of claim 1, wherein the water content is 55-65%.

4. A low VOC press wash comprising 10-50% parachlorobenzotrifluoride; 40-70% water; 0.1-10% of a 100% VOC solvent with a flashpoint above 100° F.; 0.1-10% solvent with less than 100% VOC; 0.10-5% surfactants; and optionally a corrosion inhibitor, wherein the solvent with a flashpoint above 100° F. is selected from the group consisting of Aromatic 100, Mineral Spirits, Aliphatic 142 Solvent, Aromatic 150 and blends thereof.

5. A low VOC press wash comprising 10-50% parachlorobenzotrifluoride; 40-70% water; 0.1-10% of a 100% VOC solvent with a flashpoint above 100° F.; 0.1-10% solvent with less than 100% VOC; 0.10-5% surfactants; and optionally a corrosion inhibitor, wherein the solvent with less than 100% VOC is selected from the group consisting of example mineral oil and paraffin solvent and blends thereof.

6. The press wash of claim 1, having 100 grams/liter or less volatile organic compounds.

7. A method of cleaning press equipment comprising using the press wash of claim 1, by applying the composition to the press.

* * * * *